United States Patent [19]

Nakamura et al.

[11] 4,225,843

[45] Sep. 30, 1980

[54] VARIABLE ATTENUATOR

[75] Inventors: Moritoshi Nakamura; Ichiro Mutoh; Tetsuhiro Kiyono, all of Miyagi, Japan

[73] Assignee: Alps Electric Co., Ltd., Tokyo, Japan

[21] Appl. No.: 920,641

[22] Filed: Jun. 29, 1978

[30] Foreign Application Priority Data

Jun. 29, 1977 [JP] Japan ..... 52-85811
Jun. 29, 1977 [JP] Japan ..... 52-85812

[51] Int. Cl.[2] ..... H01C 10/30
[52] U.S. Cl. ..... 338/120; 338/160
[58] Field of Search ..... 338/49, 118, 120, 160, 338/162, 307–309; 333/81 R

[56] References Cited

U.S. PATENT DOCUMENTS

| | | | |
|---|---|---|---|
| 1,881,446 | 10/1932 | Flanzer | 338/309 X |
| 3,924,207 | 12/1975 | Simoni | 333/81 R |
| 4,146,853 | 3/1979 | Kiyono, et al. | 333/81 R |

FOREIGN PATENT DOCUMENTS

| | | | |
|---|---|---|---|
| 920241 | 1/1947 | France | 338/162 |

OTHER PUBLICATIONS

Kiyono, et al., German Printed Application, 2,650,018 10/76.
Japanese Patent Publication, 5644, 4/63.

*Primary Examiner*—C. L. Albritton
*Attorney, Agent, or Firm*—Guy W. Shoup; Gerard F. Dunne

[57] ABSTRACT

A variable attenuator comprises a generally horseshoe-shaped main resistance element, a sliding member movable thereover, and a bypass provided around that portion of the main resistance element adjacent the end portion of the path of said sliding member. The bypass is made of a conductive element or conductive element and a resistance element, the amount of current flowing through said bypass being thereby increased to enable a maximum attenuation.

7 Claims, 4 Drawing Figures

VARIABLE ATTENUATOR

BACKGROUND OF THE INVENTION

It has recently been required that variable attenuators used in audio products have a large maximum attenuation characteristic. Many variable attenuators have a comparatively low total resistance of, for example, lower than 10 kΩ, and it is now required that these attenuators be able to produce a maximum attenuation in the order of −100 dB to −120 dB.

A variable attenuator generally consists of a resistance element having conductive members typically made of a silver paste provided at the respective end portions of the resistance element. Terminals are secured to the conductive members, and a sliding member connected electrically to a tap terminal is slidingly movable along the resistance element. In such a variable attenuator, a sliding member is moved along the resistance element while a voltage is applied between the two terminals, so as to extract an attenuation voltage in accordance with the amount of movement of the sliding member. However, even when the sliding member is moved to the end portion of its path, a slight amount of voltage usually occurs across the sliding member due to a resistance existing in those portions of the conductive members that are between the end portion of the sliding members and the terminals secured to the conductive members. This offers an obstruction to the improvement of maximum attenuation amount in a variable attenuator having a comparatively low total resistance. For example, when the total resistance is 10 kΩ, with the resistance in the conductive members being 1Ω, the maximum attenuation amount is normally about −80 dB (20 log 1/10000), which is far lower than the currently demanded value of −100 dB to −120 dB.

Therefore, an object of the present invention is to provide a variable attenuator which will be able to obtain a large maximum attenuation amount even when the attenuator has a low total resistance.

Another object of the present invention is to provide a variable attenuator having a simple construction and a large maximum attenuation amount.

Still another object of the present invention is to provide a variable attenuator, which can be easily manufactured at a low cost and which has a large attenuation amount.

A further object of the present invention is to provide a variable attenuator which is especially suitable for controlling the sound volume of audio devices.

DETAILED DESCRIPTION OF THE INVENTION

Figure 1:
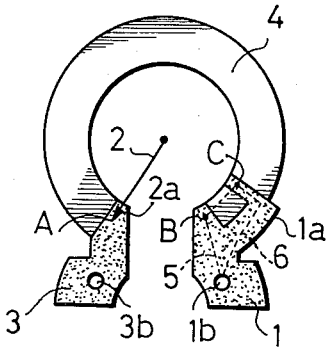
FIG. 1 is a plan view of a first embodiment of the present invention, from which the patterns of the resistance element and conductive members and the arrangement of the sliding member may be understood.

Referring to FIG. 1, terminals 1*b* and 3*b* are provided on respective conductive members 1 and 3, each consisting of a coated or printed layer of silver paste, for example. The conductive members 1 and 3 are each connected to respective end portions of a substantially horseshoe-shaped main resistance element 4. A sliding member 2 has a sliding portion 2*a* freely movable over the main resistance element 4 from the conductive member 3 to the conductive member 1. The conductive member 1 has a branching conductive portion 1*a* made of a conductive material, and the branching conductive portion 1*a* consists of a leg portion extending from the conductive member 1 and along the outer edge portion of the resistance element 4 so as to be outside the path of the sliding member 2, and an arm portion extending from the leg portion across the path of the sliding member 2. The branching conductive portion 1*a* may be made from the same material as the conductive members 1 and 3, such as a coated or printed layer of, for example, silver paste. The sliding member 2 is movable between a point A on the conductive member 3 and point B on the conductive member 1. The inner end of the sliding member 2 is connected electrically to a tap terminal, as is well known in the art.

Assuming that C represents a point where the path of the sliding member 2 over the resistance element 4 crosses the branching conductive portion 1*a*; R the resistance between the terminal 3*b* and the point C; $R_1$ the resistance between the point C and the point B in a current path 5 starting at the point C, passing the point B where the path of the sliding member 2 terminates, and ending at the terminal 1*b*; r the resistance between the point B and the terminal 1*b*; and $r_1$ the resistance in a bypass, i.e., the current path 6 starting at the point C, passing through the branching conductive portion 1*a*, and ending at the terminal 1*b*, the equivalent circuit of the variable attenuator of the present invention may be as shown in FIG. 2.

Figure 2:
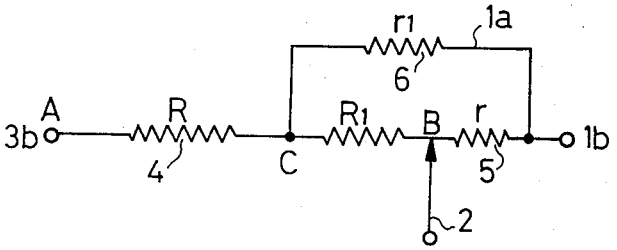
FIG. 2 is a diagram of the equivalent circuit of the embodiment as shown in FIG. 1.

Referring the FIG. 2, the same reference numerals and symbols as in FIG. 1 represent the same portions of the device as shown therein. As can be noted clearly from FIG. 2, the total resistance of the variable attenuator as shown in FIG. 1 is equal to a series resistance obtained by putting together R and a combined parallel resistance of $(R_1+r)$ and $r_1$.

When the resistance in the bypass 6, i.e., the branching conductive portion 1*a*, is sufficiently smaller than that in the path 5 including the point B, the greater part of the electric current flows through the bypass 6. Consequently, the amount of electric current flowing through the path 5 can be reduced and the voltage caused by the resistance r can be lowered considerably.

When an electric current of 1 mA is applied from the terminal 3*b* to the terminal 1*b*, which is used as ground with R, $R_1$, r and $r_1$ set to 10 kΩ, 98Ω, 1Ω, and 1Ω, respectively, and electric current of only 0.01 mA flows through the current path including the point B, i.e., the current path 5. Therefore, the voltage caused by the resistance r between the point B and terminal 1*b* is $10^{-5}$ V (0.01 mA×1Ω=0.01 mV). Since the total resistance in the variable attenuator is approximately 10 kΩ, the voltage between the terminals 3*b* and 1*b* is approximately 10 V. Then, the voltage caused by the resistance r converted into a maximum attenuation amount is −120 dB (20 log $10^{-5}$/10).

Figure 3:
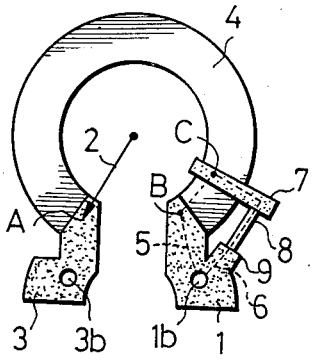
FIG. 3 is a plan view of a second embodiment of the present invention, from which the patterns of the resistance element and conductive members and the arrangement of the sliding member may be understood.

FIG. 3 shows a second embodiment of the present invention. In this embodiment, the branching conductive portion 1*a* forming the bypass 6 is supplied by a combination of a conductive strip 7, resistance portion 8 and a conductive part 9, and the equivalent circuit of this is the same as that shown in FIG. 2. Therefore, the second embodiment produces the same effect as the first embodiment shown in FIG. 1.

Figure 4:
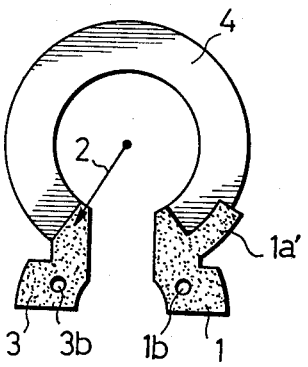
FIG. 4 is a plan view of a third embodiment of the present invention, from which the patterns of the resistance element and conductive members and the arrangement of the sliding member may be understood.

FIG. 4 shows a third embodiment of the present invention, in which the arm portion of the branching conductive portion of the embodiment as shown in FIG. 1 is omitted. In the third embodiment provided with a branching conductive portion 1*a'*, the flow of electric current is somewhat different from that in the embodiment as shown in FIG. 1, but in practice a maximum attenuation amount which poses no problems can be obtained.

Thus, the third embodiment which has a simple construction is also useful.

What is claimed is:

1. A variable attenuator including a resistance element, first and second conductive members each electrically connected to a respective end portion of said resistance element and having respective first and second terminals connected thereto, a sliding member slidingly movable along said resistance element between a first position on said first conductive member and a second position on said second conductive member, and means associated with said first conductive member for reducing the voltage drop between said sliding member and said first terminal when said sliding member is in said first position, said reducing means including a conductive bypass for electric current extending from said first conductive member to a part of said resistance element spaced therefrom to provide a path shunting current away from the current path including said sliding member and first terminal.

2. A variable attenuator according to claim 1, wherein said bypass consists of a leg portion extending along the upper surface of said resistance element and outside the path of said sliding member, and an arm portion crossing the path of said sliding member.

3. A variable attenuator according to claims 1 or 2, wherein said bypass is made of a silver paste.

4. A variable attenuator according to claim 1, wherein said bypass consists of a conductive strip crossing the path of said sliding member, a conductive part extending from said first conductive member, and a resistance portion having a low resistance and extending from said conductive strip to said conductive part.

5. A variable attenuator according to claim 4, wherein said first and second conductive members, said conductive strip and said conductive part, are made of silver paste.

6. A variable attenuator according to claim 1, wherein said bypass consists of a single portion which is extended outside the path of said sliding member from said first conductive member.

7. A variable attenuator according to claim 6, wherein said bypass is made of silver paste.

* * * * *